US005882762A

United States Patent [19]

Goeman

[11] Patent Number: 5,882,762

[45] Date of Patent: Mar. 16, 1999

[54] CARPET YARN HAVING HIGH SOIL RESISTANCE

[75] Inventor: Bart Goeman, Steendorp, Belgium

[73] Assignee: Minnesota Mining and Manufacturing Company, St. Paul, Minn.

[21] Appl. No.: 808,491

[22] Filed: Feb. 27, 1997

[30] Foreign Application Priority Data

Mar. 7, 1996 [EP] European Pat. Off. ..... 96103564

[51] Int. Cl.[6] ..... B32B 3/02

[52] U.S. Cl. ..... 428/97; 428/396; 57/243; 57/258

[58] Field of Search ..... 428/97, 396; 57/243, 57/258

[56] References Cited

U.S. PATENT DOCUMENTS

| | | | |
|---|---|---|---|
| 2,723,999 | 11/1955 | Cowen et al. | 260/615 |
| 2,915,554 | 12/1959 | Ahlbrecht et al. | 260/556 |
| 3,787,351 | 1/1974 | Olson | 260/40 R |
| 3,839,312 | 10/1974 | Oxenrider | 260/93.7 |
| 3,870,567 | 3/1975 | Palmer et al. | 136/148 |
| 4,043,964 | 8/1977 | Sherman et al. | 260/29.6 F |
| 4,107,055 | 8/1978 | Sukornick et al. | 252/8.6 |
| 4,190,545 | 2/1980 | Marshall et al. | 252/8.75 |
| 4,192,754 | 3/1980 | Marshall et al. | 252/8.8 |
| 4,264,484 | 4/1981 | Patel | 260/29.6 |
| 4,317,736 | 3/1982 | Marshall | 252/8.75 |
| 4,855,360 | 8/1989 | Duchesne et al. | 525/187 |
| 4,857,251 | 8/1989 | Nohr et al. | 264/103 |
| 4,920,168 | 4/1990 | Nohr et al. | 524/188 |
| 4,933,229 | 6/1990 | Insley et al. | 428/224 |
| 5,025,052 | 6/1991 | Crater et al. | 524/104 |
| 5,244,954 | 9/1993 | Fasulo et al. | 534/315 |

FOREIGN PATENT DOCUMENTS

| | | |
|---|---|---|
| 0 122 623 | 10/1984 | European Pat. Off. . |
| 0 516 271 | 12/1992 | European Pat. Off. . |
| WO 92/18569 | 10/1992 | WIPO . |
| WO 95/01396 | 1/1995 | WIPO . |
| WO 95/33882 A | 12/1995 | WIPO . |
| WO 96/01916 A | 1/1996 | WIPO . |

OTHER PUBLICATIONS

Colourage, "Spin Finishes", Bajaj et al., Nov. 16–30, 1987.
Textile Research Journal, 43, 325–335 (1973).
Tappi Journal, "New Fluorochemicals for Protective Clothing", May 1992, pp. 124–132.
European Search Report for EPA 96 103564.9

*Primary Examiner*—Terrel Morris
*Attorney, Agent, or Firm*—Eloise J. Maki

[57] ABSTRACT

This invention relates to carpet yarn comprising a plurality of filaments of a thermoplastic polymer with a fluorochemical or non-fluorochemical hydrophilicity imparting compound dispersed within said filaments. In another aspect, the invention relates to a method of producing carpet yarn and to the use of the carpet yarn for the production of carpet having high soil resistance.

24 Claims, No Drawings

CARPET YARN HAVING HIGH SOIL RESISTANCE

TECHNICAL FIELD

This invention relates to carpet yarn, more particularly to carpet yarn comprising a plurality of filaments of a thermoplastic polymer. In another aspect, the invention relates to a method of producing a carpet yarn. In a further aspect, the invention relates to the use of the carpet yarn for the production of carpet having high soil resistance.

BACKGROUND

In the formation of textile materials from extruded thermoplastic polymers, such as poly(alpha-olefin)s, application of a spin oil to the filaments, yarns, or other textile embodiments thereof, is a standard practice. Spin oil, also called spin finish, is an essential lubricating composition deposited on the surface of the man-made fiber to reduce the fiber-fiber friction and the friction developed as the yarn passes over the metal machinery surfaces. The primary function of a spin oil is to provide surface lubricity to the yarn. Spin oils also reduce the static charges in the hydrophobic fibers. They reduce the electrical resistance of the fibers thereby allowing faster dissipation of the charges. Spin oils help prevent fiber yarn breakage. Spin oil contains a large number of chemical components, the major components being lubricant, antistatic agent and emulsifier. In addition it can also contain small portions of additives such as antioxidant, corrosion inhibitors, defoamers and antibacterial product. The amount of spin oil needed depends on producer and on manufacturing steps which follow to convert fibers into useful end products. Typically between about 0.9% and 5% of spin oil is needed. A major disadvantage is that residues of spin oil on the extruded fiber reduce the soil resistance of the finished product.

In the industrial production of textiles, such as carpet and apparel, it is common to treat such substrates with a composition to impart added desirable properties thereto, such as resistance to soiling by particulate or dry soil. Certain fluorochemical compositions are commercially used for this purpose. They can be applied to various substrates by methods which include, for example, spraying, foaming, padding, and finish bath immersion.

U.S. Pat. No. 4,264,484 discloses a liquid carpet treating composition containing a water-insoluble addition polymer derived from polymerizable, ethylenically unsaturated monomer free of nonvinylic fluorine and having at least one major transition temperature higher than about 25° C., and a water-insoluble fluoroaliphatic radical- and aliphatic chlorine-containing ester having at least one major transition temperature higher than about 25° C.

U.S. Pat. No. 4,107,055 discloses a fabric coating composition, including a polymer having a glass transition temperature above room temperature, an ionic fluorinated surfactant and a carrier. The polymer is preferably applied to fabric at a rate giving a dry solids content of about 0.25 to 10%, to give dry soil resistance.

U.S. Pat. No. 4,043,964 discloses a coating which provides a durably soil-resistant carpet which contains (a) at least one phase of a specified water-insoluble addition polymer derived from a polymerizable ethylenically unsaturated monomer free of non-vinylic fluorine and (b) at least one phase of a specified water-insoluble fluorinated component containing a fluoroaliphatic radical of at least 3 carbon atoms. The monomer from which the fluorinated component is formed may contain dicarboxylic acid, glycol, diamine, hydroxyamine, etc.

A common feature of the treating or coating compositions disclosed in the above mentioned U.S. Pat. Nos. 4,264,484, 4,107,055 and 4,043,964 is that they are to be applied to the carpet or fabric after its production in a separate treating step. The application equipment and time required for such treating step add to the cost of the final product.

Textile fibers and yarns can also be treated by incorporation of the fluorochemical in the spin finishing bath. For example, U.S. Pat. Nos. 4,190,545 and 4,192,754 disclose spin finish and yarn finish compositions for incorporation with synthetic organic polymer yarn or yarn products to render the same oil repellent and resistant to soiling. The composition comprises (a) a solution of a salt of dioctylsulfosuccinate, propylene glycol and water, and (b) a fluorochemical compound consisting of polycarboxybenzene esterified with certain partially fluorinated alcohols and with hydroxyl-containing organic radicals such as 2-hydroxyethyl, glyceryl and chlorohydryl or bromohydryl.

Alternatively, treated textile fibers and yarns can be obtained by melt extrusion of a blend of a synthetic fiber-forming polymer and a fluorochemical composition. Such melt extrusion is described for example in U.S. Pat. No. 3,839,312. This patent discloses that soil and stain repellency of extruded filaments of a synthetic resin can be improved by incorporating in the resin a small amount, about 1 percent, of an amphipathic compound having from one to four fluoroalkyl groups pendent from an organic radical. The repellency is provided by the fluoroalkyl groups, which tend to be concentrated at the surface of the fiber.

WO 92/18569 and WO 95/01396 disclose permanently soil resistant polymeric compositions such as fibers and yarns that have a fluorochemical dispersed throughout the polymer. These polymer compositions are prepared by melt extrusion of the fluorochemical with the desired polymer. Polymers that can be used with the fluorochemical include polyester, polypropylene, polyethylene and polyamide.

U.S. Pat. No. 5,025,052 discloses certain fluoroaliphatic group-containing oxazolidinone compositions. The patent also discloses fibers, films, and molded articles prepared, for example, by injection molding a blend or mixture of fiber-or film-forming synthetic organic polymers and certain fluorochemical oxazolidinones. The resulting fibers, films, and molded articles are said to have low surface energy, oil and water repellency, and anti-soiling properties.

European Pat. Pub. No. 0 516 271 discloses durably hydrophilic thermoplastic fibers comprising thermoplastic polymer and fluoroaliphatic group-containing non-ionic compounds.

While many currently used fluorochemical compositions have demonstrated utility in providing carpet with soil resistance, unfortunately a significant amount of the carpet manufactured cannot be treated to obtain the desired properties. The reason is that significant and varying amounts of spin oil often remain on the carpet face pile, lowering the soiling resistance of the carpet or acting as contaminants which interfere with the fluorochemical treatment and diminish or prevent the desired result thereof. Since in every carpet line different amounts of residual spin oil can be observed, it is difficult in the operation of a carpet mill to predict which of the carpet lines are going to present problems in obtaining satisfactory soil resistance. Scouring the carpet should be a solution of this problem. However, this method is not acceptable to the industry for economical reasons.

It is an object of the present invention to provide carpet yarn, more particular carpet yarn comprising a plurality of filaments of a thermoplastic polymer, that can overcome above mentioned shortcomings because of a reduced amount of spin oil needed to provide proper lubrication of the filaments, or, because as in one embodiment, the spin oil can be replaced by water. It is a further object of the invention to provide a method of producing a carpet yarn having improved soil resistance. Furthermore, it is an object of the invention to provide a process for converting the yarn into a carpet having high soil resistance.

SUMMARY OF THE INVENTION

Briefly, in one aspect, the present invention provides carpet yarn comprising a plurality of filaments of a thermoplastic polymer with a hydrophilicity imparting compound dispersed within said filaments. It has in particular been found that the presence of the hydrophilicity imparting compound in the filaments allows production of carpet yarn with a reduced amount of spin oil or even without the spin oil normally required. In particular, the spin oil can at least partially be replaced by water. As a result of the reduced amount of spin oil, carpets produced using such yarn are less susceptible to soiling. Further, it was found that carpet yarn in accordance with this invention has a bulkier look than carpet yarn not having the hydrophilicity imparting compound probably due to less cohesion between the filaments as a consequence of the reduced spin oil. The hydrophilicity imparting compound in connection with the present invention can be a fluorochemical or a non-fluorochemical compound or a mixture of these compounds. The use of a fluorochemical hydrophilicity imparting compound is however preferred.

In a further aspect, the present invention provides a method of producing a carpet yarn comprising a plurality of filaments of a thermoplastic polymer having improved soil resistance which comprises the steps of a) preparing a mixture comprising the thermoplastic polymer and a hydrophilicity imparting compound, b) extruding the mixture to form filaments c) treating the filaments in a spin finishing bath, and d) stretching a bundle of filaments to obtain a yarn.

In another aspect the present invention provides a method for using the carpet yarn for the production of carpet having high soil resistance, without the need for scouring the carpet or treating it with soil resistant compositions.

The carpet yarn of the present invention comprising a hydrophilicity imparting compound dispersed within its filaments and present at the surface thereof which may be prepared by the above-mentioned method provides a unique solution to the problems encountered in the prior art caused by residual spin oil. U.S. Pat. No. 3,839,312 discloses the addition of fluorochemical compounds having from one to four fluoroalkyl groups pendent from an organic radical to polypropylene fibers. These fluorochemical compounds do not impart hydrophilicity to the fibers. Even if not mentioned in the patent, application of spin oil is necessary in order to ensure lubrication and to avoid electrostatic charge of the fiber. This results in the above discussed disadvantageous interference of spin oil and fluorochemical treatment. The same problems are found with the polypropylene fiber treated with a fluorochemical oxazolidinone composition of U.S. Pat. No. 5,025,052.

In contrast thereto the carpet fiber of the present invention is hydrophilic due to the presence of the hydrophilicity imparting compound which is dispersed within the filaments, and, as may be concluded from the lubrication properties, is also present at the surface thereof. This allows a considerable reduction of the spin oil or even the use of water as spin finish liquid.

The carpet fibers of U.S. Pat. Nos. 4,190,545 and 4,192,754 which are treated with a spin finish comprising a fluorochemical compound having an aromatic group become oil repellent. This characteristic is not achieved with the carpet fibers of the present invention. The polypropylene fiber disclosed in European Pat. Pub. No. 0 516 271 which is durably hydrophilic because of the presence of a fluoroaliphatic group-containing non-ionic compound which imparts hydrophilicity to the surface thereof is not a stretched fiber and not suitable for use in carpet production.

DETAILED DESCRIPTION

Thermoplastic polymers useful in the invention include fiber-forming poly(alpha)olefins, polyesters and polyamides. Preferred thermoplastic polymers are poly (alpha) olefins. The poly(alpha)olefins of the present invention include the normally solid homo-, co- and terpolymers of aliphatic mono-1-olefins (alpha olefins) as they are generally recognized in the art. Usually the monomers employed in making such poly(alpha)olefins contain 2 to 10 carbon atoms per molecule, though higher molecular weight monomers sometimes are used as comonomers. The invention is applicable also to blends of the polymers and copolymers prepared mechanically or in situ. The monomers employed include ethylene, propylene, butene-1, pentene-1, 4-methylpentene-1, hexene-1, and octene-1, alone, or in admixture, or in sequential polymerization systems.

Examples include polyethylene, the presently preferred polypropylene, propylene/ethylene copolymers, polybutylene and blends thereof. Processes for preparing various polymers are well known, and the invention is not limited to a polymer made with a particular catalyst or process.

Hydrophilicity imparting compounds suitable for use in this invention can be fluorochemical or non-fluorochemical or a mixture of such compounds can be employed. Non-fluorochemical hydrophilicity imparting compounds are substantially free of fluorine (preferably containing less than 10% by weight and more preferably less than 5% by weight of fluorine) and are generally hydrophilic in nature or contain at least a hydrophilic moiety such that hydrophilicity or wettability can be provided to the surface of the thermoplastic polymer filaments. Included are low molecular weight compounds, oligomers as well as polymers. Suitable non-fluorochemical hydrophilicity imparting compounds are preferably incompatible with the thermoplastic polymer melt and are preferably sufficiently stable at the required extrusion temperatures.

Suitable non-fluorochemical hydrophilicity imparting compounds can be anionic, cationic, non-ionic or amphoteric. Preferred compounds are surfactants. Particularly preferred non-fluorochemical hydrophilicity imparting compounds are those that contain a poly(oxyalkylene) group.

Fluorochemical hydrophilicity imparting compounds which are useful in the techniques of this invention are hydrophilic in nature and include compounds, oligomers, and polymers. For convenience, they are generally referred to herein as fluorochemical compounds. Such materials will contain at least about 10% by weight of fluorine, i.e. carbon-bonded fluorine. They contain one or more fluorochemical radicals ($R_f$), and one or more water solubilizing polar groups (Z), which radicals and groups are usually connected together by suitable linking groups (Q).

The fluorochemical radical, $R_f$, in the agent can be generally described as a fluorinated, preferably saturated, monovalent radical of at least 4 carbon atoms. Preferably the fluorochemical radical is a fluoroaliphatic, non-aromatic radical. The aliphatic chain may be straight, branched, or, if sufficiently large, cyclic and may include oxygen, di- or hexavalent sulfur, or trivalent nitrogen atoms bonded only to carbon atoms. A fully fluorinated radical is preferred, but hydrogen or chlorine atoms may be present as substituents provided that no more than one atom of either is present for every two carbon atoms.

Fluoroaliphatic radicals containing about 5 to about 12 carbon atoms are most preferred.

The water solubilizing polar group or moiety, Z, of the fluorochemical agent can be a non-ionic, anionic, cationic, or amphoteric moiety, or combinations of said groups or moieties which may be the same or different. Preferably, the water solubilizing group comprises a poly(oxyalkylene) group, (OR')x, where R' is an alkylene group having 2 to 4 carbon atoms, such as $—CH_2CH_2—$, $—CH_2CH_2CH_2—$, $—CH(CH_3)CH_2)—$, and $—CH(CH_3)CH(CH_3)—$ or mixtures thereof, and x is an integer from about 6 to about 20. The oxyalkylene units in said poly(oxyalkylene) may be the same, as in poly(oxypropylene), or present as a mixture, such as in a heteric straight or branched chain of randomly distributed oxyethylene and oxypropylene units poly (oxyethylene-co-oxypropylene), or as in a straight or branched chain of blocks of oxyethylene units and blocks of oxypropylene units. The poly(oxyalkylene) chain can be interrupted by or include one or more catenary linkages, providing such linkages do not substantially alter the water-solubilizing character of the poly(oxyalkylene) chain and preferably is terminated with hydroxyl or lower alkyl ether moieties, for example, $—OCH_3$ or $—OCH_2CH_3$.

Typical anionic groups include $CO_2H$, $CO_2M$, $SO_3H$, $SO_3M$, $OSO_3H$, $OSO_3M$, $OPO(OH)_2$, and $OPO(OM)_2$, where M is a metallic ion (such as sodium or potassium), or ammonium ion, or other amine cation. Typical cationic groups include $NR_3^+A^-$, where R is a lower alkyl group such as methyl, ethyl, butyl, hydroxyethyl or hydrogen and A is an anion such as chloride, sulfate, phosphate, hydroxide or iodide. Typical mixed or amphoteric groups would include $N^+(CH_3)_2C_2H_4COO^-$, $N^+(CH_3)_2C_3H_6SO_3^-$ or an amine-oxide.

The linking group, Q, is a multivalent, generally divalent, linking group such as alkylene, arylene, sulfonamidoalkylene, carbonamidoalkylene, and other heteroatom-containing groups such as siloxane, including combinations of such groups. In some instances more than one fluoroaliphatic radical may be attached to a single linking group and in other instances a single fluoroaliphatic radical may be linked by a single linking group to more than one polar solubilizing group. Q can also be a covalent bond.

A particularly useful class of fluorochemical agents which can be used in the invention are those of the formula $$(R_f)_nQ_aZ$$

where $R_f$ is said fluoroaliphatic radical, n is 1 or 2, Q is said linking group, a is zero or one and Z is said water solubilizing group.

The hydrophilicity imparting fluorochemical compounds useful in the present invention can be prepared using known methods such as those described in U.S. Pat. No. 2,915,554 (Albrecht et al.). The Albrecht patent discloses the preparation of fluoroaliphatic group-containing non-ionic compounds from active hydrogen containing fluorochemical intermediates, such as fluoroaliphatic alcohols, e.g. $R_fC_2H_4OH$, acids e.g. $R_fSO_2N(R')CH_2COOH$, and sulfonamides, e.g., $R_fSO_2N(R')H$, by reaction of the intermediates with, for example, ethylene oxide to yield, respectively, $R_fC_2H_4O(C_2H_4)_nH$, $R_fSO_2N(R')CH_2CO_2(C_2H_4O)_nH$, and $R_fSO_2N(R')(C_2H_4O)_nH$, where n is a number greater than about 3, and R' is hydrogen or lower alkyl (e.g., 1 to 6 carbons). Analogous compounds can be prepared by treating the intermediates with propylene oxide or a mixture of ethylene oxide and propylene oxide. See also the fluoroaliphatic oligomers disclosed in U.S. Pat. No. 3,787,351 (Olson), and certain fluorinated alcohol-ethylene oxide condensates described in U.S. Pat. No. 2,723,999 (Cowen et al.). The hydrophilicity imparting fluorochemical compound is added in amounts between about 0.05 and 2% by weight, preferably between about 0.5 and 1.5% by weight, based on the total weight of thermoplastic polymer and fluorochemical compound.

In accordance with the present invention a carpet yarn can be produced by providing a mixture comprising a thermoplastic polymer and one or more hydrophilicity imparting compounds. This mixture can be extruded to form filaments which are then treated in a spin finishing bath. The filaments are preferably cooled prior to such treatment. To obtain a carpet yarn, a bundle of filaments is stretched. Stretching may be accomplished over a pair of rolls that are at elevated temperature sufficient to soften the thermoplastic polymer. By rotating the rolls in a pair at different speeds, stretching of the filaments can be obtained. While stretching can be accomplished with one pair of rolls, it may be desirable to stretch the filaments over two pairs. Typically, the filaments will be stretched 3 to 4 times the extruded length. Subsequent to stretching, it will often be desirable to texture the carpet yarn with pressured air at an elevated temperature or steam jet and to subject it to an entanglement.

Spin finish which is useful in the present invention includes any conventional spin oil used for the extrusion of thermoplastic polymers. Surprisingly, the spin finish can also be water without any spin oil added to it. The spin finish can be applied using methods known in the art. One example includes kiss roll application. The lower part of the kiss roll dips in the finish bath, while the yarn tangentially moves over the top part. The add-on level of spin oil can be varied by changing several parameters, such as the geometry between yarn and roll, roll speed and the concentration of spin oil in the spin finishing bath. When spin oil is used, the parameters will be adjusted so that the residual amount of spin oil on the filament will be between about 0.01% and 1.2% by weight, preferably between about 0.01% and 0.6% by weight, based on the total weight of filaments and spin oil. Most preferably, the residual amount of spin oil will be less than 0.4%.

It may furthermore be desirable to wet the filaments during or subsequent to the stretching operation applied thereto. In this way lubrication may be improved when the filaments leave the stretching unit. Loss of lubrication may occur during stretching as a result of evaporation of water during stretching. Similarly, prior or subsequent to texturing, wetting of the yarn may compensate for loss of lubrication during texturing.

Testing Procedures

The following tests have been used to evaluate the carpet yarn of the present invention.

Determination of Fluorine in the Fiber

In order to determine the amount of fluorine in the extruded fiber, following method is used: a known weight of the sample is placed in an ignition basket made from platinum wires. The sample is then decomposed in a sealed polycarbonate flask in the presence of oxygen and a known volume of buffer solution, TISAB III (available from Orion). After absorption in the buffer solution, the fluoride is measured with an Orion 9409 (fluoride sensitive) electrode connected to a pH meter using the mV-mode of operation. The amount of fluoride is then calculated from the mV reading using a graph plotted from standard fluoride solutions. All samples are analyzed in duplicate and the results should show less than 10% variation to be considered uniform. When properly calibrated, the electrode measurement will be reproducible with a deviation of about 2%.

Carpet Walk-on Test

The soil resistance properties of the carpets made from the carpet yarn of the present invention were measured following the guidelines of the American Association of Textile Chemists and Colorists (AATCC) Standard Test Method No. 122-1987: "Carpet Soiling: Service Soiling Method", with some deviations as outlined below.

Carpet test specimen were put in the walk-on area, without using a standard level of soiling, until a predetermined number of foot traffics was obtained. The foot traffic was measured electronically using a Hengstler 890 'electronic eye', available from Hengstler Belgium, Brussels. After ending the walk-on test, all test samples were vacuum cleaned before evaluation. The degree of soiling was measured as a color deviation compared to a reference white plate using a Minolta Chroma Meter II Reflectance, obtainable from Minolta Camera Co, Japan. (The coordinates, printed on the white plate and given by Minolta Camera Co were Y: 88.7, x: 310 and y: 318). The Minolta Chroma Meter II Reflectance records the color difference as delta E (Δ E). A lower Δ E value represents a lower degree of soiling; a Δ E value of 3 or higher represents a visible difference in soiling.

Abbreviations

The following abbreviations and trade names are used in the examples:

MeFOSA: $C_8F_{17}SO_2NH_2$

EtFOSEMA: N-ethyl perfluorooctyl sulfonamido ethylmethacrylate

BuFOSEA: N-butyl perfluorooctyl sulfonamido ethylacrylate

Jeffamine™ ED 600: ethylene oxide-propylene oxide amino terminated, available from Huntsman, USA CW 750 A: acrylate of a methoxy polyethylene glycol of average molecular weight of 750, commercially available from British Petroleum International Ltd, UK Pl 44A: acrylate of an ethylene oxide-propylene oxide-ethyleneoxide glycol (commercially available as Pluronic™ 44 from BASF AG, Germany)

Genopol™ 26-L-80: $C_{12-16}H_{25-33}(OCH_2CH_2)_{9.5}OH$, derived from a primary alcohol, commercially available from Hoechst Celanese Corp., USA

EXAMPLES

All parts, ratios, percentages etc. in the following examples and the rest of the specification, are by weight unless otherwise noted.

Mixtures of hydrophilicity imparting compounds and thermoplastic polymer were prepared and extruded into filaments in accordance with methods known in the art. The temperature of extrusion is kept below 310° C. in order to prevent decomposition. A bundle of filaments was treated in a spin finishing bath comprising an aqueous solution of spin oil or only water, after which the bundle was stretched to form a yarn. The yarn was subsequently tufted to form carpet.

Hydrophilicity imparting compounds:

Fluorochemical compounds:

FC-1 $C_8F_{17}SO_2N(C_2H_5)CH_2CH_2O(CH_2CH_2O)_7CH_3$ (prepared according to U.S. Pat. No. 2,915,554)

FC-2 2 $C_8F_{17}SO_3H$. Jeffamine ED-600 di-salt (compound no. 1 in U.S. Pat. No. 4,975,363)

FC-3 a copolymer of EtFOSEMA/CW 750A in a ratio of 30/70, prepared according to U.S. Pat. No. 3,787,351 example 2.

FC-4 a copolymer of BuFOSEA/Pl 44A in a ratio of 30/70 and prepared according to U.S. Pat. No. 3,787,351 example 1.

FC-5 a fluorochemical group containing non-ionic compound of the structure $C_8H_{17}SO_2N(C_2H_5)(CH_2CH_2O)_2$-$(CH(CH_3)CH_2O)_6H$ prepared according to U.S. Pat. No. 2,915,554

FC-6 $C_8F_{17}SO_2N(CH_3)$-Genopol™ 26-L-80 made from $C_8F_{17}SO_2NH_2$ and Genopol™ 26-L-80 according to the following procedure.

To a 3-necked roundbottom flask equipped with overhead stirrer, thermometer, reflux condensor and two attached gas washing bottles, the second bottle containing a 10% aqueous solution of sodium hydroxide, was charged 200.83 g (0.337 eq) of Genapol™ 26-L-80 and 5.5 g of Celite™ filter agent (commercially available from Aldrich Chemical Co.). The mixture was heated to 60° C., then 48.12 g (0.4045 eq, a 20% molar excess) of thionyl chloride was added via an addition funnel over a period of about 22 minutes, raising the mixture temperature to 75° C. Then nitrogen was bubbled through the reaction mixture for 4 hours, during which time the mixture temperature varied from 68°–71° C. The reflux condensor and gas washing bottles were replaced by a still head, and the reaction mixture was stirred while a vacuum of about 50 torr absolute pressure was applied. After the reaction was shown to be complete by $^{13}C$ and $^{1}H$ analysis of an aliquot, the reaction mixture was filtered hot through a C-porosity flitted glass Buchner funnel to yield Genapol™ 26-L-80 chloride.

To a 3-necked round-bottom flask equipped with overhead stirrer, reflux condensor and nitrogen inlet adapter was charged 125 g (0.244 eq) of $C_8F_{17}SO_2NH_2$ (MeFOSA), 179.93 g (0.249 eq, or a 2% molar excess) of the Genapol™ 26-L-80 chloride (from the preparation given above), 37.71 g (0.355 eq, or a 50% molar excess) of sodium carbonate and 2.76 g (0.0141 eq, or 8.5 mole percent with respect to MeFOSA) of potassium iodide. The reaction mixture was heated to 120° C. for 8 hours, at which time the MeFOSA had disappeared according to analysis using gas chromatography. After cooling to 95° C., the reaction mixture was washed with 157 g of 10% aqueous sulfuric acid followed by 157 g of deionized water. The washed reaction mixture was concentrated by evaporation on a rotary evaporator at 70° C. and 50 torr absolute pressure to give a straw colored liquid, whose structure was characterized by 13C and 1H NMR spectroscopy to be consistent with the desired ether adduct.

Non-fluorochemical hydrophilicity imparting compounds:

HC-1 Triton™ X-100, an ethoxylated (9.5) alkylphenol, commercially available from Union Carbide Corp., USA.

Thermoplastic polymer: polypropylene with a melt index of 12, available from Borealis NV, Brussels, Belgium.

Carpet Yarn

In a first step, masterbatches of polypropylene containing various amounts of hydrophilicity imparting compound were prepared. The method of forming the blend is not critical. The blend can be formed by injecting an FC or HC compound into a twin screw extruded barrel in which the polypropylene is already in a molten state.

The extruded compound was then cut into granules or pellets. In a second step, the granules were further blended with polypropylene in various amounts to give different ratios of polypropylene/hydrophilicity imparting compound as given in tables 1 and 5. Comparative examples C-1 to C-4 were made from pure polypropylene, without any addition of FC or HC compound.

The so formed blends were extruded with a Thermo Alfa single screw extruded (Triply extruded—one end) at about 230° C. over spin plates with a trilobal cross section.

After leaving the extruder, the filaments passed through a cooling zone over a kiss roll where a solution of water with a conventional spin oil, such as Lertisan 2515 (examples 1 to 8, C-1 to C-3) or FA 2825 (examples 10 to 17, C-4), available from Zschimmer und Schwartz, was applied. Alternatively, the spin finish bath only contained water (example 9).

The amount of spin oil applied to the yarn was varied by adjusting the kiss roll speed and the concentration of spin oil in the spin finishing bath. In the experiments, the kiss roll speed was varied between 19 and 7.5 rpm and the concentration of spin oil in the spin finishing bath was varied between 0 and 15%. The carpet yarn was then drawn at about 3–4 times the extruded length to obtain a yarn with a tex (weight (g)/1000 m) of about 165 (examples 1 to 9 and C-1 to C-3) or about 200 (examples 10–17 and C-4). The yarn was textured at a temperature of 140° C. to 180° C. to produce a bulked yarn that is particularly useful for production of carpets.

The bulked yarn was visually inspected for mechanical quality after spinning and texturing. Bulked yarn made in accordance with the present invention had no visible broken filaments.

The yarn was then tufted into carpet by conventional means.

TABLE 1

Composition of polypropylene filaments

| Example No. | % FC-1 compound | % Spin oil* |
|---|---|---|
| 1 | 0.3 | 1.2 |
| 2 | 0.3 | 0.6 |
| 3 | 0.3 | 0.3 |
| 4 | 0.6 | 0.7 |
| 5 | 0.6 | 0.3 |
| 6 | 0.6 | 0.2 |
| 7 | 0.8 | 0.2 |
| 8 | 0.8 | 0.1 |
| 9 | 0.8 | 0 |
| C-1 | 0 | 0.9 |
| C-2 | 0 | 0.5 |
| C-3 | 0 | 0.3 |

Notes: % spin oil*: residual spin oil on the fiber; determined by acetone extraction.

The fiber from example 1 shows higher level of residual spin oil than the fiber of comparative example C-1, although the spin finishing conditions were the same (same kiss roll speed and spin oil concentration in the bath). Through the hydrophilicity imparting effect of the fluorochemical compound more spin oil is picked-up from the kiss roll.

Comparative example C-3, containing no fluorochemical compound or HC compound and only 0.3% spin oil, could be processed on the pilot equipment used under close surveillance. The conditions were however borderline and not practical for large scale experiments. The high static build up is unacceptable for production scale. Because of the low level of spin oil used, filament repellency occurs. The filament bundle widens causing problems during further production steps, such as texturation and entanglement.

On the other hand, example 9, containing no spin oil (treated in a spin finishing bath containing only water, thus without any addition of spin oil), but containing 0.8% fluorochemical compound shows no production problems at all. No static build up is noticed.

The Thermo Alfa single screw extruder, used for extrusion of the fibers, requires a constant pressure before the spin pump of 5000 KPa. In order to maintain this pressure, the extruder unit automatically adjusts the speed of the extruder screw. It has been observed that by using fluorochemical compound, the extrusion pressure is more constant resulting in less fluctuation of the speed of the extruder screw. As a result, the extrusion process runs smoother. Less motor current is needed (monitored during extrusion process and recorded in table 2) and a reduction in noise level is observed.

TABLE 2

Extrusion parameters

| Example No. | Speed of extruder screw (rpm) | Motor current (A) |
|---|---|---|
| 1 | 90 | 2.5 |
| 2 | 90 | 2.5 |
| 3 | 89 | 2.4 |
| 4 | 95 | 2.0 |
| 5 | 94 | 2.0 |
| 6 | 94 | 1.9 |
| 7 | 85 | 1.7 |
| 8 | 85 | 1.7 |
| 9 | 85 | 1.7 |
| C-1 | 60 | 3.8 |
| C-2 | 59 | 3.8 |
| C-3 | 59 | 3.8 |

Notes: For safety reasons, in order not to damage the extruder screw, the extruder screw speed is programmed not to exceed 100 rpm. For examples 7–9, the spin pump speed was manually lowered from 20 rpm to 18.5 rpm, because, to obtain a pressure of 5000 KPa, the screw needed to exceed 100 rpm. Examples 1–9 show a clear lubricating effect of the fluorochemical compound. Less energy is required to obtain the same pressure (aimed at 5000 KPa before the spin pump).

Physical properties of the polypropylene carpet yarn were measured using an Instron Dynamometer (gauge: 500 mm; cross head speed 11 mm/sec). The results, recorded in table 3 are mean values of 20 measurements.

TABLE 3

Physical properties of polypropylene carpet yarn

| Ex No. | E-1 (N/tex) | E-2 (N/tex) | Tensile strength max (N/tex) | Peak elongation (%) | Elongation at break (%) |
|---|---|---|---|---|---|
| 1 | 1.9 | 1.6 | 0.27 | 33 | 43 |
| 2 | 1.9 | 1.6 | 0.27 | 32 | 43 |
| 3 | 1.8 | 1.5 | 0.25 | 59 | 42 |
| 4 | 1.8 | 1.5 | 0.26 | 33 | 48 |
| 5 | 1.8 | 1.5 | 0.24 | 29 | 47 |
| 6 | 1.5 | 1.2 | 0.2 | 29 | 43 |
| 7 | 2.2 | 1.9 | 0.3 | 30 | 49 |
| 8 | 1.9 | 1.5 | 0.25 | 28 | 48 |
| 9 | 2 | 1.7 | 0.23 | 22 | 48 |
| C-1 | 2 | 1.7 | 0.27 | 31 | 43 |
| C-2 | 1.9 | 1.6 | 0.26 | 30 | 46 |
| C-3 | 1.9 | 1.6 | 0.24 | 28 | 45 |

Notes: modulus E-1: modulus between 1 and 3% elongation
modulus E-2: modulus between 1 and 5% elongation
tex = weight of sample (g)/1000 meter.

As can be seen from the results, the physical properties of the filaments remain very similar, although the amount of fluorochemical compound and/or spin oil is varied.

Carpet Production

In a third step, the yarn was tufted on a Cobble ST 85 RE machine of 1 m width, simulating industrial tufting equipment. The setting was 252 needles/meter. The tuft speed was 1200 rpm. The tuft sheet used was polypropylene, both woven and non woven fabric.

The carpets produced were tested for their soil resistance properties by subjecting them to the Walk-on test for 9000 footsteps. The results of Δ E are given in Table 4.

TABLE 4

Walk-on test results of polypropylene carpet

| Ex No. | ΔE (9000 footsteps) even backing | ΔE (9000 footsteps) non woven backing |
|---|---|---|
| 1 | 28.1 | 30.6 |
| 2 | 27.2 | 28.6 |
| 3 | 24.0 | 24.0 |
| 4 | 27.0 | 27.2 |
| 5 | 23.5 | 23.3 |
| 6 | 20.5 | 24.2 |
| 7 | 19.5 | 22.8 |
| 8 | 18.3 | 21.7 |
| 9 | 15.2 | 18.7 |
| C-1 | 28.0 | 30.6 |
| C-2 | 26.8 | 28.5 |
| C-3 | 22.7 | 23.7 |

As expected, no major differences are observed between carpets with woven and non woven backing.

The results clearly indicate that carpet with superior soil resistance can be made using lower level of spin oil than in standard practice. Example 9, made from carpet yarn treated with pure water and no spin oil, has the best soil resistance properties. Although it seems that comparative example C-3 has good antisoiling properties too, as mentioned above, this example cannot be practiced on large scale due to high static build up.

Examples 10 to 17 and comparative example C-4

Examples 10 to 17 were made using different hydrophilicity imparting fluorochemical compounds and/or non-fluorinated polyoxyethylene-group containing compounds as given in table 5. Depending on the viscosity of the compound, masterbatches were prepared having different concentration of the compound in polypropylene. The final composition is chosen so that the extruded fiber contains about 1.2% of fluorochemical compound. This ratio is higher for the non-fluorinated compound (about 2%). Comparative example C-4 is made without addition of a FC or HC compound.

TABLE 5

Composition of polypropylene filaments

| Example No. | Hydrophilicity imparting compound | % Spin oil in bad | % Spin oil residual* |
|---|---|---|---|
| 10 | FC-1 | 3 | 0.32 |
| 11 | FC-2 | 3 | 0.38 |
| 12 | FC-3 | 3 | 0.30 |
| 13 | FC-4 | 3 | 0.30 |
| 14 | FC-5 | 3 | 0.34 |
| 15 | HC-1 | 3 | 0.25 |
| 16 | FC-6 | 3 | 0.40 |
| 17 | FC-6/HC-1 14/86 | 3 | 0.30 |
| C-4 | / | 15 | 1.7 |

Note: Residual spin oil *: residual spin oil on the fiber; determined by acetone extraction.

In order to be processable, comparative example C-4 without hydrophilicity imparting compound, needed a spin finish bath concentration which was much higher than the samples containing hydrophilicity imparting compound (residual spin finish preferably at least 1%).

It has been observed that by using hydrophilic compound, the extrusion process runs smoother. Less motor current is needed (monitored during extrusion process and recorded in table 6) and a reduction in noise level is observed.

TABLE 6

Extrusion parameters

| Example No. | Speed of extruder screw (rpm) | Motor current (A) |
|---|---|---|
| 10 | 88–89 | 1.75 |
| 11 | 62–64 | 2.35 |
| 12 | 77–80 | 2.35 |
| 13 | 80–92 | 2.15 |
| 14 | 52–53 | 3.10 |
| 15 | 65–68 | 2.55 |
| 16 | 53–57 | 3.80 |
| 17 | 78–80 | 2.10 |
| C-4 | 50–51 | 3.95 |

Physical properties of the polypropylene carpet yarn were measured using an Instron Dynamometer (gauge: 500 mm; cross head speed 11 mm/sec). The tensile strength (maximum) and elongation at break of the yarn was measured according to the ISO 2062 norm (1972) (the tex was measured according to the ISO 2060 norm (1972)). The results, recorded in table 7 are mean values of 20 measurements.

TABLE 7

Physical properties of polypropylene carpet yarn

| Ex. No | Tex | Tensile Strength (cN/tex) | Elongation (%) |
|---|---|---|---|
| 10 | 208 | 19.7 | 27 |
| 11 | 208 | 20.7 | 26 |
| 12 | 207 | 20.4 | 27 |
| 13 | 207 | 20.9 | 26 |
| 14 | 206 | 20.9 | 26 |
| 15 | 202 | 21.1 | 26 |
| 16 | 203 | 19.6 | 25 |
| 17 | 203 | 20.3 | 27 |
| C-4 | 171 | 21.8 | 25 |

Note: tex = weight of sample (g)/1000 meter

As can be seen from the results, the physical properties of the filaments remain very similar.

Carpet Production

In a third step, the yarn was tufted on a Cobble ST 85 RE machine of 1 m width, simulating industrial tufting equipment. The setting was 252 needles/meter. The tuft speed was 1200 rpm. The tuft sheet used was woven polypropylene. The carpets produced were tested for their soil resistance properties by subjecting them to the Walk-on test for 9000 footsteps. The Walk-on test described above was modified in that as a reference sample, the corresponding unsoiled sample (which was not layed out in the walk-on area) of a sample being tested was used. This eliminates slight color changes of the fiber caused by some of the additives. The results of ΔE are given in table 8.

TABLE 8

Walk-on test results of polypropylene carpet

| Ex No. | ΔE (9000 footsteps) woven backing |
|---|---|
| 10 | 4.4 |
| 11 | 4.0 |
| 12 | 3.8 |
| 13 | 3.9 |
| 14 | 4.7 |
| 15 | 4.8 |
| 16 | 5.2 |
| 17 | 4.6 |
| C-4 | 10.7 |

I claim:

1. A carpet yarn comprising a plurality of filaments of a thermoplastic polymer with a hydrophilicity imparting compound dispersed within said filaments wherein said hydrophilicity imparting compound comprises fluorochemical.

2. A carpet yarn according to claim 1, wherein said hydrophilicity imparting compound consist of fluorochemical.

3. A carpet yarn according to claim 2, wherein the thermoplastic polymer is a poly(alpha)olefin.

4. A carpet yarn according to claim 3, wherein the poly(alpha)olefin is polypropylene.

5. A carpet yarn according to claim 2, wherein the fluorochemical compound is a fluoroaliphatic compound.

6. A carpet yarn according to claim 5, wherein the fluoroaliphatic compound is represented by the formula $$R_f—Q—Z,$$

wherein $R_f$ is a fluorinated, monovalent residue having at least 3 carbon atoms, Q is a linking group or a covalent bond and Z is a hydrophilicity imparting group.

7. A carpet yarn according to claim 6, wherein the fluoroliphatic compound comprises poly(oxyalkylene) units as hydrophilicity imparting groups.

8. A carpet yarn according to claim 6, wherein Z comprises a polyoxyalkylene group $(OR')_x$, where R' is an alkylene group having 2 to 4 carbon atoms and x is an integer from about 6 to 20.

9. A carpet yarn according to claim 2, wherein the amount of fluorochemical is from 0.05 to 2.0% by weight, based on the total weight of thermoplastic polymer and fluorochemical compound.

10. A carpet yarn according to claim 1, which further comprises spin oil on the surface of the filaments, and wherein the total amount of spin oil present on the yarn is less than 0.4% by weight, based on the total weight of the carpet yarn and the spin oil.

11. A carpet yarn according to claim 10, wherein the total amount of spin oil present on the yarn is about 0.01 to 0.4% by weight, based on the total weight of the carpet yarn and the spin oil.

12. A carpet comprising the carpet yarn of claim 1.

13. A carpet yarn according to claim 1, wherein the hydrophilicity imparting compound further comprises non-fluorochemical.

14. A carpet yarn according to claim 13, wherein the non-fluorochemical comprises poly(oxyalkylene) units.

15. A method of producing a carpet yarn comprising a plurality of filaments of a thermoplastic polymer having improved soil resistance which comprises the steps of:

a) preparing a mixture comprising a thermoplastic polymer and a hydrophilicity imparting compound, wherein the hydrophilicity imparting compound comprises fluorochemical, b) extruding the mixture to form filaments, c) treating the filaments in a spin finishing bath, and d) stretching a bundle of filaments to obtain a yarn.

16. A method according to claim 15, wherein said hydrophilicity imparting compound consists of fluorochemical.

17. A method according to claim 16, wherein the amount of fluorochemical is from 0.05 to 2% by weight, based on the total weight of thermoplastic polymer and fluorochemical.

18. A method according to claims 15, wherein the spin finishing bath consists of water.

19. A method according to claims 15, wherein the spin finishing bath comprises water and a spin oil.

20. A method according to claim 15 wherein said filaments are wetted ring and/or subsequent to said stretching.

21. A method according to claim 15 wherein the obtained yarn is further textured and said yarn is wetted prior and/or subsequent to said texturing.

22. A method according to claim 15, wherein the spin finishing bath contains a sufficient amount of spin oil such that the filaments retain on their surface, after treatment in the bath, a residual amount of spin oil of 0.01 to 4% by weight, based on the total weight of the filaments and spin oil.

23. A method according to claim 15, wherein the hydrophilicity imparting compound further comprises non-fluorochemical.

24. A method according to claim 23, wherein the non-fluorochemical comprises poly(oxyalkylene) units.

* * * * *